US008159128B2

(12) United States Patent
Peter

(10) Patent No.: US 8,159,128 B2
(45) Date of Patent: Apr. 17, 2012

(54) SEALED THICK FILM DIELECTRIC ELECTROLUMINESCENT DISPLAY

(75) Inventor: Manuela Peter, Toronto (CA)

(73) Assignee: iFire IP Corporation, Oakville, Ontario (CA)

( * ) Notice: Subject to any disclaimer, the term of this patent is extended or adjusted under 35 U.S.C. 154(b) by 707 days.

(21) Appl. No.: 11/773,140

(22) Filed: Jul. 3, 2007

(65) Prior Publication Data

US 2008/0124541 A1 May 29, 2008

Related U.S. Application Data

(60) Provisional application No. 60/818,275, filed on Jul. 5, 2006.

(51) Int. Cl.
*H01J 1/62* (2006.01)
*H01J 63/04* (2006.01)

(52) U.S. Cl. ..... 313/506; 313/483; 313/498; 313/500; 313/503; 313/504; 313/50; 313/502

(58) Field of Classification Search ..... None
See application file for complete search history.

(56) References Cited

U.S. PATENT DOCUMENTS

| | | | | |
|---|---|---|---|---|
| 4,767,679 | A * | 8/1988 | Kawachi | 428/690 |
| 6,830,494 | B1 * | 12/2004 | Yamazaki et al. | 445/24 |
| 7,042,546 | B2 * | 5/2006 | Tamashiro et al. | 349/190 |
| 7,063,902 | B2 * | 6/2006 | Kikuchi et al. | 428/690 |
| 7,226,333 | B2 * | 6/2007 | Ikagawa | 445/24 |
| 7,417,368 | B2 * | 8/2008 | Wu et al. | 313/503 |
| 2004/0061437 | A1 * | 4/2004 | Ikagawa | 313/506 |

FOREIGN PATENT DOCUMENTS

| | | |
|---|---|---|
| CN | 1291786 | 12/2004 |
| CN | 1706227 | 12/2005 |

* cited by examiner

*Primary Examiner* — Natalie Walford
(74) *Attorney, Agent, or Firm* — Fay Sharpe LLP

(57) ABSTRACT

The invention is a sealed thick film dielectric display where the display comprises a thick film dielectric display structure and an adhesive layer provided over the display structure. The invention also provides a seal where the seal comprises an adhesive layer bonded to the underside of a cover plate and to the surface of a thick film dielectric electroluminescent display. The seal substantially inhibits the exposure of display components to atmospheric contaminants.

20 Claims, 6 Drawing Sheets

SEALED THICK FILM DIELECTRIC ELECTROLUMINESCENT DISPLAY

This application claims the benefit of Provisional Patent Application No. 60/818,275, filed Jul. 5, 2006, the disclosure of which is incorporated herein in its entirety, by reference.

FIELD OF THE INVENTION

The present invention relates to electroluminescent displays. In particular present invention relates to a sealed thick film dielectric electroluminescent display, sealed thick film dielectric electroluminescent devices and methods of making therefore. The invention more specifically relates to an adhesive layer provided within a thick film dielectric electroluminescent display that seals the display and substantially inhibits the exposure of display components to atmospheric contaminants.

BACKGROUND TO THE INVENTION

Full color thick film dielectric electroluminescent displays, employing thin film phosphors and thick film dielectric layers, provide a greater luminance and superior reliability over traditional thin film electroluminescent displays. However, the phosphor materials, insulator materials and thick film dielectric layer employed in these displays are susceptible to degradation due to reaction with water and other atmospheric vapors. Furthermore, the thick film dielectric layer may act as a reservoir for water and other contaminants that may react adversely with the display structure during its operation. In general, atmospheric contaminants are known to shorten the life of electroluminescent displays and thus in order to protect and minimize damage to these electroluminescent displays various types of seals have been developed for incorporation into displays.

U.S. Pat. No. 6,771,019 (the disclosure of which is incorporated herein in its entirety by reference) discloses the use of perimeter seals in thick film dielectric electroluminescent displays. Briefly, thin film phosphors are typically sandwiched between a pair of addressable electrodes and fabricated on a heat resistant substrate that is also impervious to water and atmospheric contaminants. The phosphor materials are activated by application of an electric field generated between the electrodes. A chemically impervious cover plate is typically placed over the fabricated display and sealed between the substrate and the cover plate with a perimeter seal in order to protect the phosphor material, dielectric layers and electrodes between the substrate and the cover plate. In some cases, the cover plate is on the viewing side of the display, in which case it must be optically transparent, and in other cases, the display is constructed on an optically transparent viewing-side substrate and the cover plate is positioned opposite the viewing side.

The effectiveness of perimeter seals is limited by the tendency of perimeter seals to fail by loss or lack of adhesion between the sealing material and the display substrate and/or cover plate due to stress generated due to differential thermal expansion between the display substrate and the cover plate for the display or by an externally applied mechanical stress.

To minimize ingress of atmospheric contaminants into the display structure a desiccant may be incorporated into the perimeter seal between the display substrate and the cover plate as exemplified by Applicant's co-pending International Patent Application serial number WO2004/067676 (the disclosure of which is incorporated herein in its entirety), however, the desiccant has a finite capacity to absorb these contaminants.

Conformal seal designs have also been developed that employ laminate structures applied to the viewing side of the display consisting of a laminate of one or more bi-layer structures comprising a polymer smoothing and stress relief layer on which is deposited an inorganic film that acts as a diffusion barrier to water and other atmospheric contaminants originating from the ambient environment. However the thickness of the laminated structure is limited by the optical transmissivity of the structure and may not provide a totally impervious barrier to outside contaminant vapour species.

Sealing layers have also been developed for use with other types of displays such as OLEDs as described for example in U.S. Pat. Nos. 5,920,080, 6,146,225, 6,268,695, 6,406,802, 6,891,330 and 6,896,979 and U.S. application serial numbers 2005/0238908, 2005/0248270 and 2005/0276947.

While the aforementioned references may teach the use of various types of seals and seal arrangements for electroluminescent displays, these seals and seal arrangements are not adequate for thick film dielectric electroluminescent displays. Known seals may not adequately immobilize the flux of atmospheric contaminants into the electroluminescent displays over the intended life of the display. They may also not adequately maintain the partial pressure of various vapour species within the display structure to minimize degradation of the display structure due to chemical reactions that produce vaporous reaction products. Often such reactions can be suppressed by maintaining an adequate partial pressure of these vaporous reaction products within the display structure. If the display seal is a perimeter seal, internal pressure within the display structure may increase as the display is stored or operated and may cause a bulging or separation between the display substrate and its cover glass, causing optical distortions in a high resolution colour display due to optical parallax effects and ultimately seal failure. Further, mechanical stress or stress due to temperature variation across a display or rapid temperature change exerted on a display may cause failure of a perimeter seal.

Therefore there still remains a need for an effective seal and sealing process for thick film dielectric electroluminescent displays in order to improve their operating stability and overall reliability overcomes some of the disadvantages of the prior art. The present invention solves a number of problems inherent in sealing technology for thick dielectric displays as taught in the prior art without causing significant impairment of the image quality of the display.

SUMMARY OF THE INVENTION

The present invention is a sealed thick film dielectric electroluminescent display and method of making. The display is sealed with a cover plate bonded to the display with an adhesive layer.

The seal provided by the cover plate and the adhesive layer reduces the rate of ingress of moisture and atmospheric contaminants that can react chemically with the various layers of the thick film dielectric electroluminescent display, particularly the phosphor layer as compared to conventional perimeter or conformal seals described in the prior art. This is accomplished without significant impairment of the optical performance of the thick film dielectric electroluminescent display. The seal, that is the cover plate in combination with the adhesive layer, extends beyond the edges of the active portion of the thick film dielectric electroluminescent display so that moisture or other contaminants penetrating from an edge of the seal are immobilized, or consumed by a chemical reaction, in the extended perimeter region of the adhesive layer and cannot reach the active portion of the thick film dielectric electroluminescent display.

Further, the adhesive layer facilitates the containment of gaseous and vapour species generated within the thick film dielectric electroluminescent display during operation, and can inhibit chemical reactions that cause display degradation by shifting the thermodynamic equilibrium for such reactions by the maintenance of an elevated pressure of such gaseous or vapour reaction products within the thick film dielectric electroluminescent display. A sealing structure that is a perimeter seal to bond a cover plate to the substrate in the display cannot contain pressures higher than one atmosphere, and when the internal pressure within the display approaches one atmosphere, there is a tendency for the substrate and the cover plate to bulge with respect to each other due to the lessening of atmospheric pressure pressing these two components together. This bulging can impair the optical quality of the thick film dielectric electroluminescent display, and in the case where the cover plate incorporates optical elements such as a colour conversion film, the colour uniformity and colour fidelity are significantly degraded.

Thus the present invention facilitates the containment of pressures significantly exceeding one atmosphere in small pores within in the thick film dielectric electroluminescent display without failure of the adhesive seal and without macroscopic mechanical deformation of the thick film dielectric display structure with attendant loss of colour fidelity or colour uniformity. This capability can be understood in terms of the relationship between the containable pressure P in a spherical bubble which is given by P=air where σ is the surface tension of the bubble and r is its radius.

A further advantage of the present invention is the enhancement of the safety of the display employing an adhesive layer of the invention by preventing fragmentation of the display if it is dropped or otherwise subject to mechanical abuse in much the same way as laminated safety glass does not fragment when broken.

Lastly, the adhesive seal of the invention is greatly improved as compared to perimeter seals as it is more durable and rugged. Perimeter seals may fail under mechanical or thermal stress causing the void volume enclosed by the seal to fill with atmospheric contaminants.

According to an aspect of the present invention is an adhesive layer, the adhesive layer being of an organic or polymer material and provided within a thick film dielectric electroluminescent display thus forming a sealed thick film dielectric electroluminescent display.

According to another aspect of the invention is an adhesive layer, the adhesive layer being of an organic or polymer material and wherein said adhesive layer is bonded within a thick film dielectric electroluminescent display to seal said thick film dielectric electroluminescent display, wherein said adhesive layer has one or more of the following functions: to reduce the ingress of moisture and atmospheric contaminants that react with layers of the thick film dielectric electroluminescent display; helps to contain the gaseous and vapour species generated within the thick film dielectric electroluminescent display during operation; inhibit chemical reactions that cause thick film dielectric electroluminescent display degradation; contain pressures within the thick film dielectric electroluminescent display; strengthen the overall mechanical integrity of the thick film dielectric electroluminescent display; and withstand mechanical and thermal stresses.

According to a further aspect of the present invention is a sealed thick film dielectric electroluminescent display, said display comprising an adhesive layer provided on an underside of a cover plate of said display.

According to yet another aspect of the present invention is a sealed thick film dielectric electroluminescent display, said display comprising:

a display sub-structure;

an adhesive layer provided over said display sub-structure; and a cover plate provided over said adhesive layer, wherein said adhesive layer bonds the cover plate to the display sub-structure.

In aspects of the invention, the display sub-structure comprises in order; a substrate, lower electrode, thick film dielectric layer having a smoothing layer thereon, a phosphor layer, thin film dielectric layer, sub-pixel columns, comprising an indium tin oxide layer and color conversion layer.

In further aspects of the invention, the colour conversion layer of the display sub-structure is provided directly adjacent the underside of the cover plate and the adhesive layer is provided directly adjacent the underside of the colour conversion layer.

In embodiments of the invention, the thick film dielectric electroluminescent display, adhesive layer and cover plate are aligned and laminated to form a monolithic sealed thick film dielectric electroluminescent display.

According to another aspect of the invention is a thick film dielectric electroluminescent display wherein the perimeters of the substrate and cover plate extend beyond the perimeter of the thick film dielectric electroluminescent display so that a contiguous annular portion of the adhesive layer is in direct contact with the glass or glass ceramic substrate and the cover plate.

According to a further aspect of the invention is a thick film dielectric electroluminescent display where the thickness of the adhesive layer is less than about 0.5 millimeters and the width of the contiguous annular portion of the adhesive layer is greater than about 10 millimeters. In aspects where the photoluminescent colour conversion layer is on the under side of the cover plate, the thickness of the adhesive layer may be less than about 0.05 millimeters or less than about 5% of the sub-pixel size to substantially prevent a viewing angle dependency of the colour of the image seen by the viewer due to optical parallax effects.

In aspects of the present invention, the optical index of refraction of the adhesive layer incorporated into the monolithic sealed thick film dielectric electroluminescent display is less than or about the same as the optical refractive index of the cover plate.

According to another aspect of the present invention is a method for making a sealed thick film dielectric electroluminescent display, said method comprising:

providing an adhesive layer within said display and adjacent an underside of said cover plate.

In aspects of the invention the adhesive layer is located between the cover plate and the display sub-structure, i.e. the display components.

According to another aspect of the present invention is a method for making a sealed thick film dielectric electroluminescent display, said method comprising:

(a) providing an adhesive layer to an underside of a cover plate; and (b) aligning and bonding (a) to the remainder of the display components.

In aspects this is done in a vacuum where enclosed air is removed. Furthermore, in aspects of the method the display is heated. Pressure may be applied to the heated display, cover plate and adhesive layer to form a sealed display.

According to yet another aspect of the present invention is a seal for a thick film dielectric electroluminescent display, the seal comprising:

a cover plate; and an adhesive layer precoated on an underside of said cover plate, wherein said adhesive layer and cover plate bonds to components of the thick film dielectric electroluminescent display.

Other features and advantages of the present invention will become apparent from the following detailed description. It should be understood, however, that the detailed description and the specific examples while indicating embodiments of the invention are given by way of illustration only since various changes and modifications within the spirit and scope of the invention will become apparent to those skilled in the art from said detailed description.

BRIEF DESCRIPTION OF THE DRAWINGS

The present invention will become more fully understood from the detailed description given herein and from the accompanying drawings, which are given by way of illustration only and do not limit the intended scope of the invention.

DETAILED DESCRIPTION OF THE PREFERRED EMBODIMENTS

The present invention is a sealed thick film dielectric electroluminescent display that incorporates an adhesive layer within the sealed display. The adhesive layer is provided between the cover plate and the remainder of the display components. The adhesive layer acts to bond the cover plate to the components of the thick film dielectric electroluminescent display in a manner that reduces the ingress of moisture and atmospheric contaminants that react with the layers of the thick film dielectric electroluminescent display; helps to contain the gaseous and vapour species generated within the thick film dielectric electroluminescent display during operation; inhibit chemical reactions that cause thick film dielectric electroluminescent display degradation; contain pressures within the thick film dielectric electroluminescent display without failure of the adhesive layer; strengthen the overall mechanical integrity of the thick film dielectric electroluminescent display; and withstand mechanical and thermal stresses. Thus the adhesive layer seals the thick film dielectric electroluminescent display.

The invention encompasses an adhesive layer, a thick film dielectric electroluminescent display incorporating the adhesive layer, a sealed thick film dielectric electroluminescent display and methods for making the seal and the sealed display. The invention also encompasses a seal wherein the seal comprises an adhesive layer provided on the underside of a cover plate, the adhesive layer bonding the cover plate to components of the thick film dielectric electroluminescent display.

The sealed thick film dielectric electroluminescent display of the present invention comprises a thick film dielectric layer fabricated on a glass or glass ceramic substrate according to the methods described in U.S. Pat. Nos. 5,432,015 and 6,919,126 (the disclosures of which are incorporated herein by reference). The thick film dielectric electroluminescent display does not extend to the edge of the display substrate leaving a perimeter strip bare of display components except for electrical connectors to the rows and columns of the display. In aspects, any moisture insensitive thin-film layers within the display may actually extend close to or to the edge of the display substrate as is understood by one of skill in the art. An adhesive layer of substantially uniform thickness is disposed over the display that may comprise certain patterned photoluminescent colour conversion, optical filter and contrast enhancing components on its underside to form in combination with the electroluminescent display structure sub-pixels of a full colour display as taught in Applicant's co-pending U.S. patent publication 2004/0135495 and U.S. Provisional Patent Application Ser. Nos. 60/774,604 and 60/738,984 (the disclosures of which are incorporated herein by reference in their entirety) and covered by an optically transparent cover plate.

Figure 1:
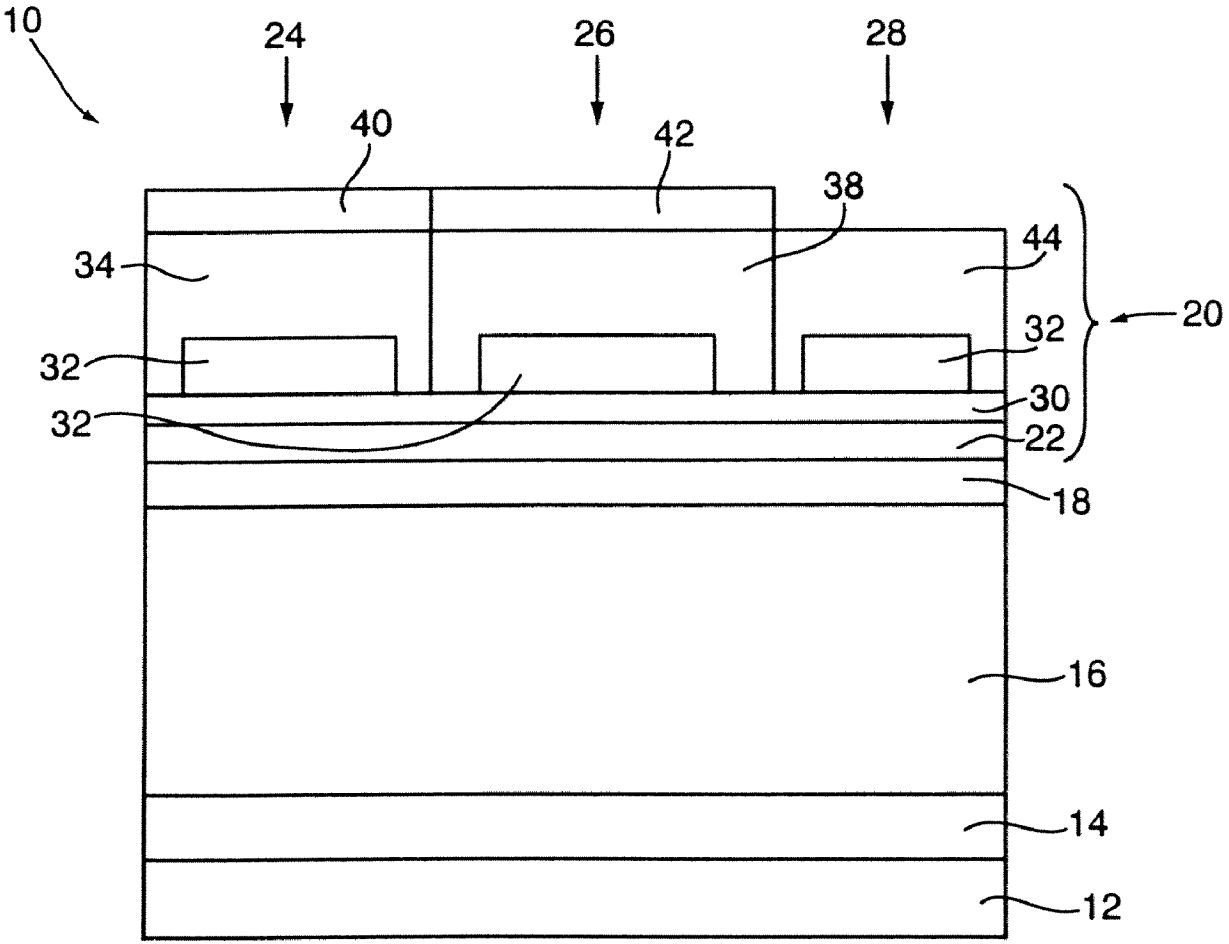
FIG. 1 shows a sectional view of a thick film dielectric electroluminescent display.

A thick film dielectric electroluminescent display 10 is shown in FIG. 1 and has a substrate 12 upon which is located a row electrode 14, a thick film dielectric layer 16 and a thin film dielectric smoothing layer 18 (together these layers 16 and 18 form a composite thick film dielectric layer). The sub-structure 20 is located on the thin film dielectric layer 18. An electroluminescent phosphor layer 22 of for example but not limited to, europium activated barium thioaluminate is provided thereon. A thin film dielectric layer 30 is located on the electroluminescent phosphor layer 22. The electroluminescent phosphor layer 22 and thin film dielectric layer 30 is deposited using a method as described in Applicant's U.S. Patent Publication 2002/0122895, (the subject matter of which is herein incorporated by reference). Three sub-pixel columns, 24, 26 and 28 are located thereon. Sub-pixel columns 24, 26 and 28 each have a viewing side electrode 32 located over the thin film dielectric layer 30. Each of the viewing side electrodes typically comprises indium tin oxide (ITO).

The configuration of the viewing side electrodes 32 are referred to as patterned (e.g. a suitable design). Each viewing side electrode 32 may comprise the same or different material. The pixel sub-structure 20 further comprises colour conversion layers, which are photoluminescent phosphor layers. In this embodiment, a portion of an optical enhancement layer 40 is integrated with a portion of a photoluminescent red-emitting colour conversion layer 34 (first colour conversion layer), which is located over the viewing side electrode 32 of the sub-pixel column 24. A portion of an optical enhancement layer 42 is integrated with a portion of a photoluminescent green-emitting colour conversion layer 38 (second colour conversion layer), which is located over the viewing side electrode 32 of the sub-pixel column 26. An optical enhancement layer 44 is located over the viewing side electrode 32 of the sub-pixel column 28. The optical enhancement layers 40, 42 and 44 are combined contrast enhancement and colour-correcting optical filtration layers. In this embodiment, the viewing side electrode 32 is made of an inert material to inhibit any potential reaction of the colour conversion layers 34 and 38 and the optical enhancement layer 44 with the viewing side electrode 32. An optically transparent barrier layer of an inert material can be disposed between the viewing side electrodes 32 and the deposited colour conversion layers 34 and 38 and the optical enhancement layer 44 to inhibit any potential reaction of the colour conversion layers 34 and 38 with the viewing side electrode 32. Optically transparent barrier layers are known. Any suitable optically transparent barrier layer may be used.

The thick film dielectric electroluminescent display in embodiments may be constructed on a glass or glass ceramic substrate by depositing in sequence a gold lower electrode set, a composite thick film dielectric comprising ferro-electric materials selected from lead magnesium niobate, lead magnesium titanate and lead zirconium titanate, with an over-layer of barium titanate, a thin film barrier layer comprising aluminum oxide, a thin film phosphor layer comprising europium activated barium thioaluminate, a second thin film barrier layer comprising aluminum oxynitride and a second electrode set comprising indium tin oxide (ITO). There may also be an organic or inorganic passivation layer deposited over the ITO electrode set followed by the photoluminescent colour conversion layer pattered to provide red, green and blue sub-pixels for the display and an optional patterned optical filter and contrast enhancement layer as described in Applicant's co-pending provisional U.S. patent application 60/738,984 filed Nov. 23, 2005. Further there may be laminated polymer and inorganic laminated sealing films deposited over the colour conversion, optical filter and contrast enhancement layer described in Applicant's co-pending provisional U.S. patent application 60/484,666 (the disclosure of which is incorporated herein by reference).

Figure 2:
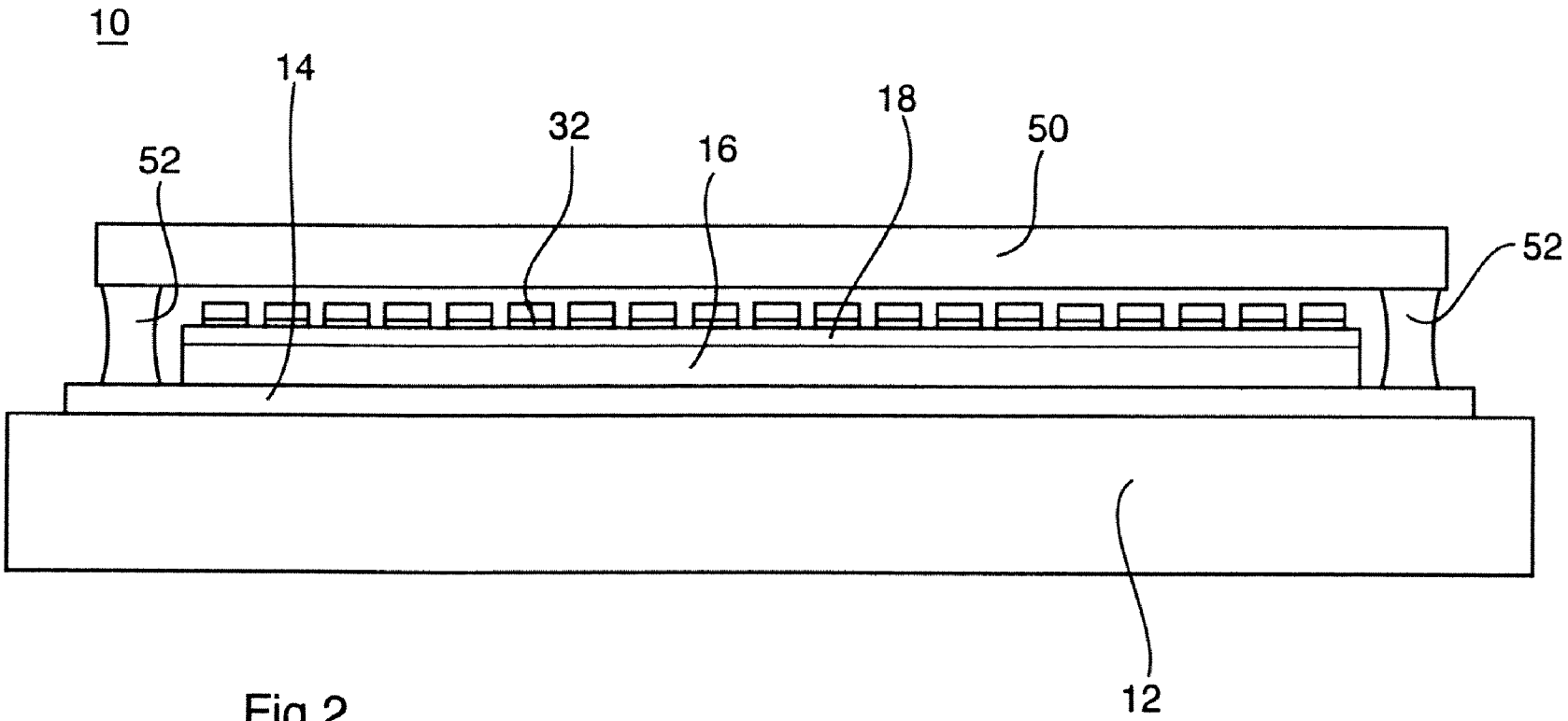
FIG. 2 is a sectional view of an electroluminescent display showing a perimeter seal incorporated therein.

FIG. 2 shows a general cross section of a thick dielectric electroluminescent display as shown in FIG. 1 having a cover plate 50 disposed over the display and sealed to the glass substrate 12 using a perimeter seal 52 to protect the display from the ambient atmosphere.

Figure 3:
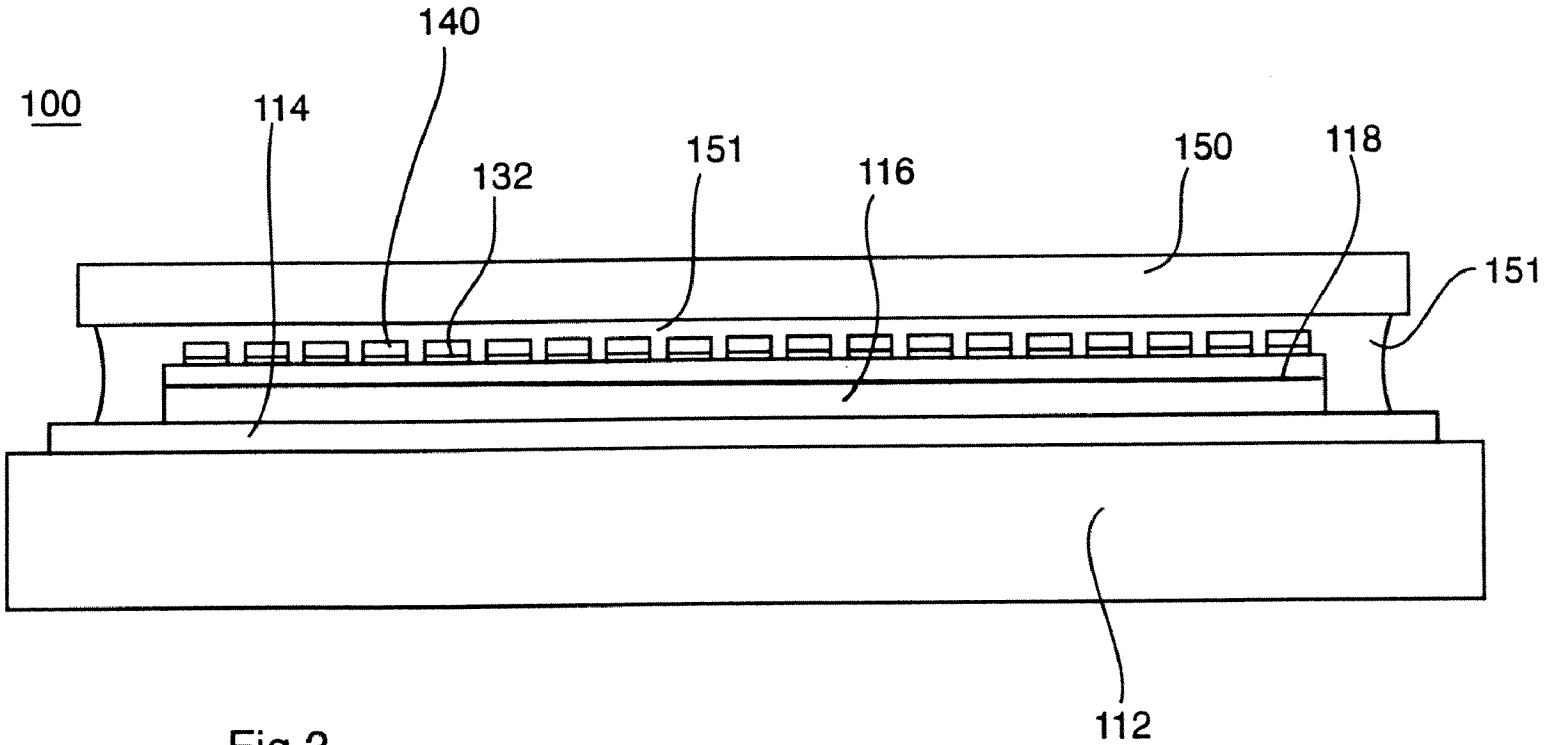
FIG. 3 is a sectional view of a sealed thick film dielectric electroluminescent display constructed according to an embodiment of the present invention.

FIG. 3 shows a cross section of a thick film dielectric electroluminescent display 100 constructed according to an embodiment of the present invention. As in FIG. 1, row electrodes 114 are deposited on a glass substrate 112. A composite thick film dielectric layer 116 and thin film dielectric smoothing layer 118 is deposited over the row electrodes 114. A phosphor layer and additional thin film dielectric layers as described in the art for thick film dielectric electroluminescent displays and herein (not shown) are deposited over and generally coincident with the thick film dielectric layer. A set of optically transparent column electrodes 132 are deposited over the thin film layers. A set of colour conversion stripes 140 (i.e. colour conversion layers) are deposited over the column electrodes 132 to form sets of red, green and blue sub-pixels. A continuous adhesive layer 151 is positioned over the display components and the substrate and extending beyond the thick film dielectric layer, thin film dielectric layer and phosphor layer. A cover plate 150 of the same area as the adhesive layer is positioned over the adhesive layer and the display components. The adhesive layer and cover plate are pressed together to form a monolithic structure.

Figure 4:
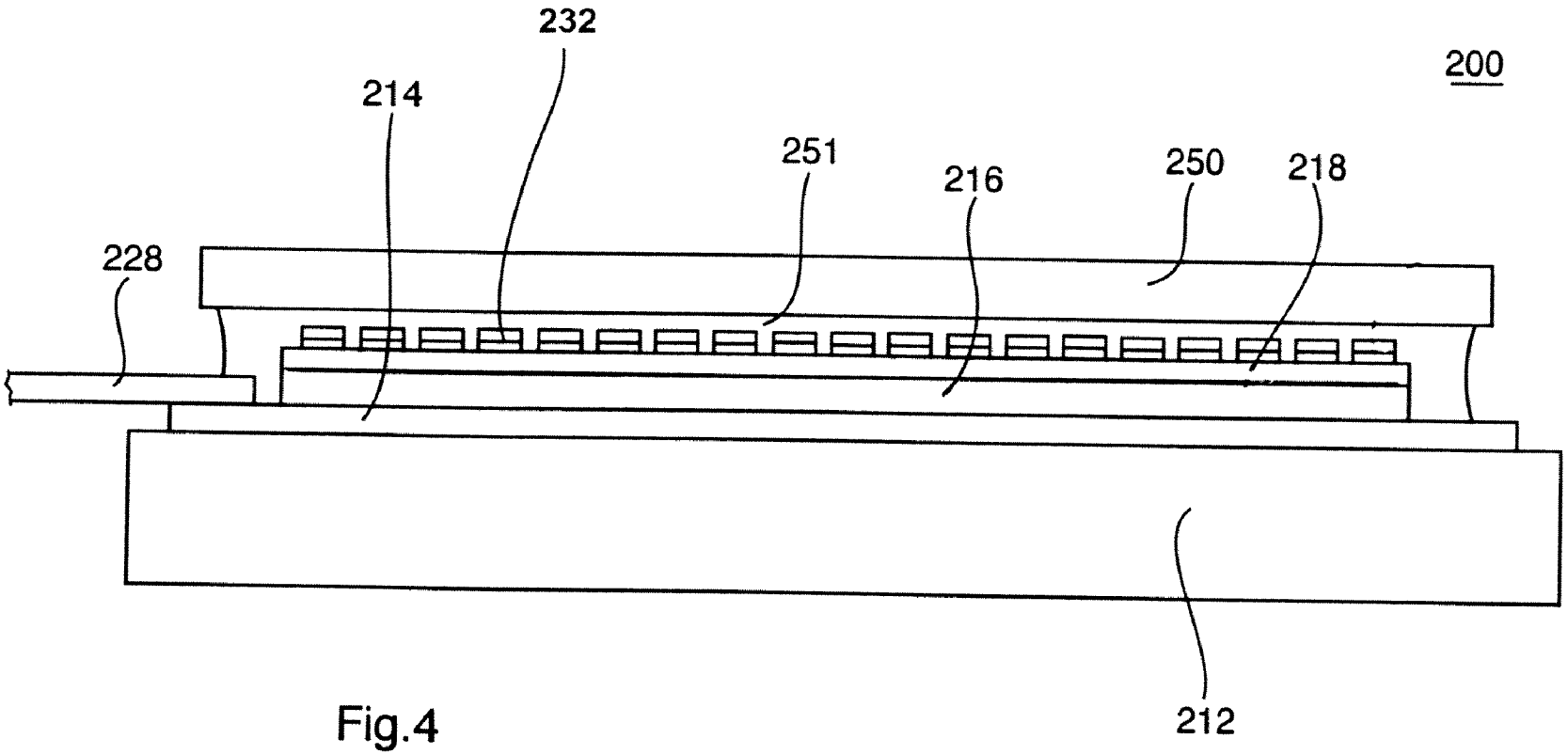
FIG. 4 is a sectional view of a sealed thick film dielectric electroluminescent display constructed according to another embodiment of the present invention.

FIG. 4 shows an alternative embodiment of the thick film dielectric electroluminescent display of FIG. 3. In this embodiment the display 200 is as shown in FIG. 2 except that flexible connector strips 228 are bonded to the row electrodes 214 and/or column electrodes 232 before a larger adhesive layer 251 and cover plate 250 are applied. This embodiment provides for physically robust connection between the connector strips and the row and column electrodes. Also shown are substrate 212, composite thick film dielectric layer 216, and thin film dielectric smoothing layer 218.

Figure 5:
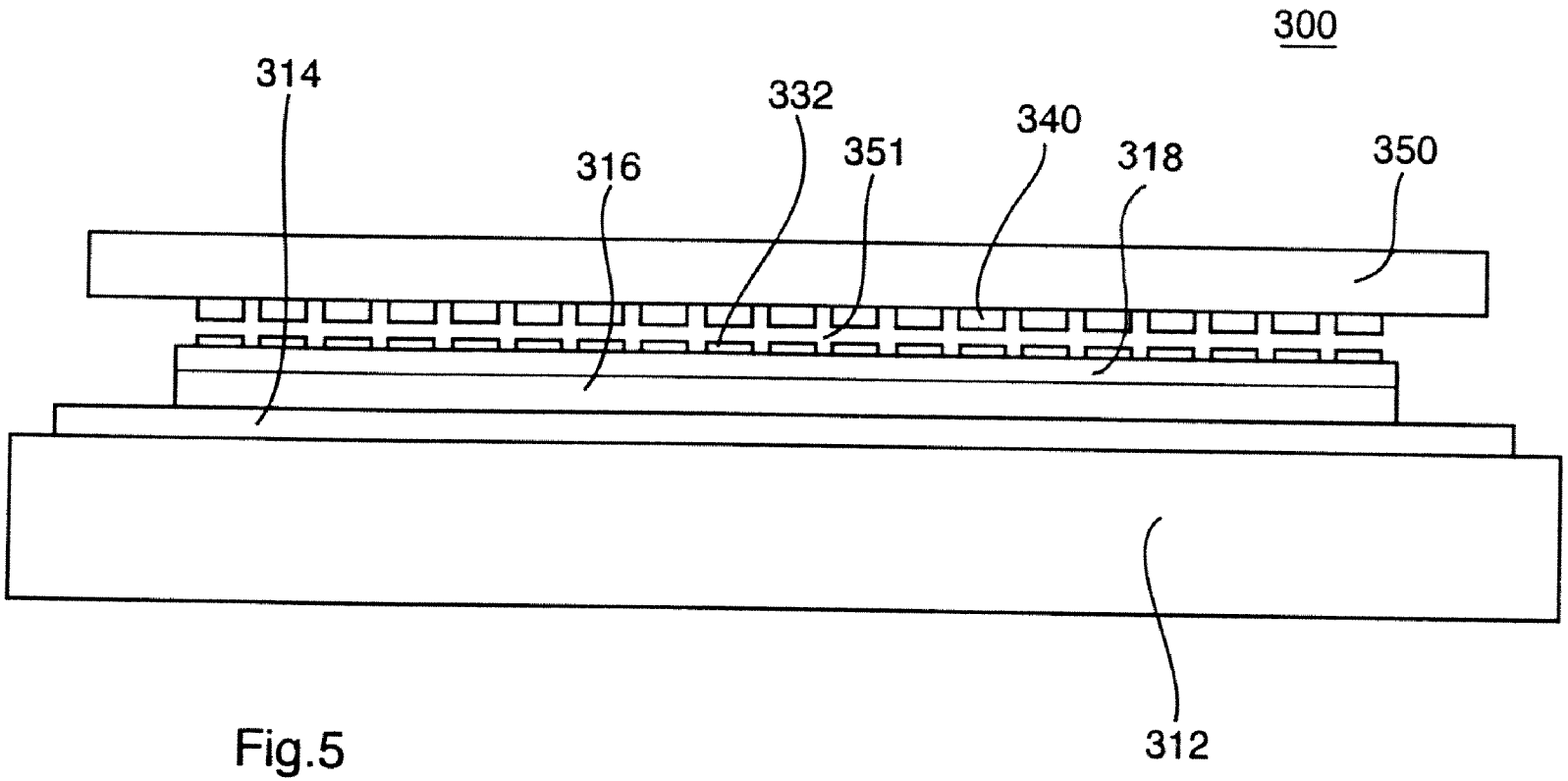
FIG. 5 is a sectional view of a sealed thick film dielectric electroluminescent display constructed according to a further embodiment of the present invention.

FIG. 5 shows an alternative embodiment of the thick film dielectric electroluminescent display similar to that shown in FIG. 3. In this embodiment the display 300 has colour conversion stripes 340 (i.e. colour conversion layers) that are deposited on the underside of the cover plate 350 instead of over the column electrodes 332 so that they are substantially aligned with the column electrodes 332 once the display components, adhesive layer 351 and cover plate 350 are bonded together. Also shown are substrate 312, row electrodes 314, composite thick film dielectric layer 316, and thin film dielectric smoothing layer 318.

Figure 6:
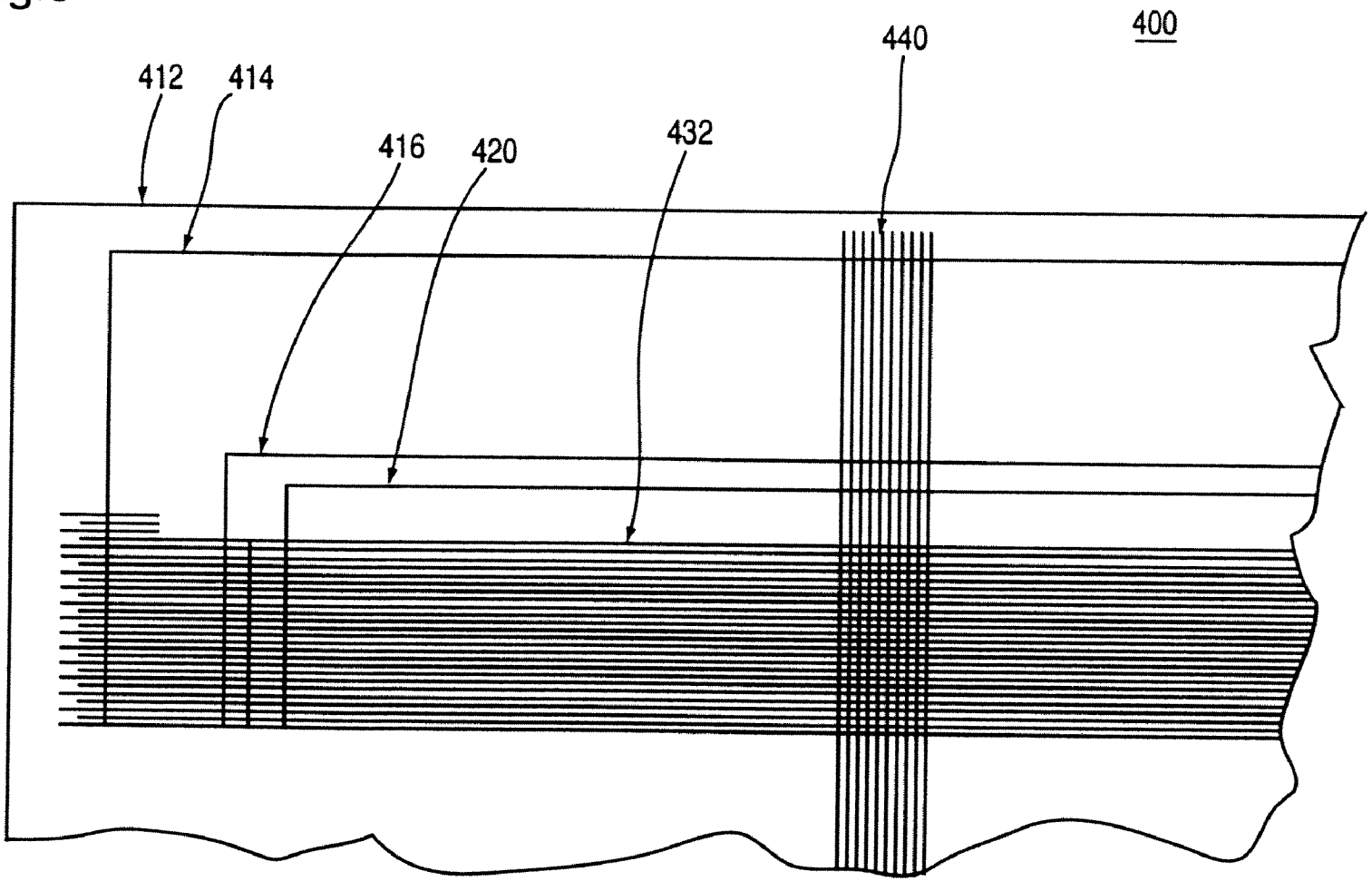
FIG. 6 shows details of a top view portion of a thick film dielectric electroluminescent display.

FIG. 6 shows a top view of a portion of a thick film dielectric electroluminescent display of the invention 400 having an adhesive layer of the present invention. Row electrodes 414 are formed on a glass substrate 412 and a thick film dielectric layer 416 is formed over the row electrodes. Additional thin film dielectric layers and a phosphor layer 420 are formed over the thick film dielectric layer. Column electrodes 432 and coincident colour conversion stripes 440 are formed over the thin film phosphor layer and dielectric layers. A continuous adhesive layer and coincident cover plate (not shown) are disposed over the electroluminescent display components.

Alternatively, the patterned optical filter and contrast enhancement layer and photoluminescent colour conversion layer may be deposited in reverse order onto an optically transparent cover plate and aligned over the display structure so that the red, green and blue sub-pixel components are suitably aligned.

The sealed thick film dielectric electroluminescent display of the present invention comprises components described herein and above that are constructed on the glass or glass ceramic substrate by placing and aligning an adhesive layer over the display components, aligning with and lowering an optically transparent cover plate onto the display components, placing the display components with the aligned adhesive layer and cover plate on a preheated platen within a vacuum chamber, evacuating the vacuum chamber, and then pressing together the adhesive layer, cover plate and display components to cure the adhesive layer and form a sealed display. Typically pressing is done in a pressure range of about 0.2 to 2 atmospheres and in aspects in the range of about 0.2 to 1 atmospheres for about 5 to 10 minutes, as is understood by one of skill in the art. The pressing may be done using a membrane bladder in contact with the entire surface area of the cover plate that is pressurized with gas to exert the pressure required to laminate the layers. Alternatively, the pressure could be applied using a mechanical platen, rollers or other means known in the art to produce laminated structures by the application of uniaxial pressure.

Prior to assembling the thick film dielectric electroluminescent display, with the adhesive layer and the cover plate, it is desirable in aspects to preheat the thick film dielectric electroluminescent display under vacuum to remove volatile species such as water that may be adsorbed within the porous components of the display that may otherwise cause degradation of the sealed display during operation or storage. The thick film dielectric layer of the display comprises ferroelectric materials that have a strong affinity for physically absorbed water. The temperature and duration for the preheating step are determined by monitoring the rate of off-gassing during heating, for example using a residual gas analyzer. The temperature for preheating should be within the range of about 120° C. to 200° C., in aspects in the range of about 150° C. to 170° C., sufficiently to remove volatile contaminant species, but not so high as to damage the display structure, cover plate or adhesive layer material as is understood by one of skill in the art.

The adhesive layer of the present invention may comprise any suitable organic material such as but not limited to ethylene vinyl acetate (EVA), thermoplastic polyurethanes (TPUs), polyvinyl butyral (PVB) or other thermoplastic or thermally curable adhesive organic materials known in the art for forming optically transparent laminated structures. It is desirable that the optical index of refraction of the cured adhesive layer be less than or about equal to that of the optically transparent coverplate to minimize transmission of light emitted by a sub-pixel along the adhesive layer or the overlying optically transparent plate to cause loss of display contrast or colour resolution. Further, it is desirable that the transmission of light through the cured adhesive layer and cover plate be achromatic over the anticipated operating life of the display so that loss of colour fidelity does not occur.

The adhesive layer may be pre-applied to the optically transparent cover plate to facilitate easier alignment of the layers during lamination to the display structure. It may also be pre-applied to the thick film dielectric electroluminescent display, but in this case, the thick film dielectric electroluminescent display must be first de-gassed to prevent bubble formation in the adhesive layer during the display laminating process.

In the case where the dimensions of the cover plate are such that they overlap the contact pads where the row and column electrodes are connected to flexible connectors to the row and column drivers, the thickness of the adhesive layer should be sufficient to allow room for insertion of the flexible connectors between the contact pads and the cover plate. For embodiments like this, the flexible connectors must be bonded to the row and column pads prior to lamination of the display structure to the adhesive layer and cover plate. To minimize transport of water and other deleterious species laterally along the adhesive layer, the thickness of this layer should be minimized. Further, the adhesive layer thickness should be minimized to minimize transmission of light emitted from the display along the adhesive layer to degrade the contrast and colour resolution of the display and to minimize absorption of light across the layer. The desired thickness of the adhesive layer should be in the range of about 0.05 to about 0.5 mm. The adhesive layer may in aspects of the invention be applied to the desired thickness as two thinner layers for example. The distance for overlap for rows and columns may be the same or different depending on the thickness of the connection pads for rows and columns and if they are substantially different.

The optically transparent cover plate used in the invention may be glass, polycarbonate, polyvinylidine fluoride or any suitable optically transparent polymer material that provides a barrier to vapour species. If a polymer cover plate is used it may be coated with an inorganic thin film on its inner surface to minimize moisture permeation through the cover plate, provided that adhesion between the inorganic coating and the adhesive layer and between the inorganic layer and the cover plate is adequate to prevent delamination of the sealed display. Coating of an inorganic layer on the outer surface of the cover plate is typically not satisfactory due to the possibility of scratching or other mechanical abrasion of the inorganic layer, thereby reducing its effectiveness as a barrier to moisture and other environmental contaminants. Coating of the outer surface however can make the surface more scratch resistant, which may be important for esthetic reasons.

The thickness of the cover plate should be sufficient to act as a barrier to diffusion of water and other atmospheric species, but thin enough to minimize propagation of light along the cover glass to prevent loss of contrast or colour resolution. Typically, the thickness of the glass should be in the range of about 0.2 to 0.5 millimeters.

The conditions for heating and pressing the laminate to form the sealed thick film dielectric electroluminescent display are understood by one of skill in the art for forming adhesive bonded laminates. Prior to lamination, the lamination vacuum chamber containing the sheets to be laminated is evacuated to a pressure in the range of about 0.5 to 1 milliTorr. The thick film dielectric display which includes the substrate are heated to a temperature of about 155° C. and a pressure of 0.2 to 1 atmospheres is applied for about 7 minutes. During pressing, some extrusion of the adhesive layer beyond the perimeter of the cover plate typically occurs. To minimize the extent of extrusion beyond the perimeter of the cover plate, the adhesive layer can be cut to a size slightly smaller than the cover plate, but in this case and especially for very thin cover plates, pressure must be applied carefully to the laminate to prevent fracture of the cover plate at its edges before the adhesive has time to flow to fill the space near the perimeter of the cover plate.

To ensure that excessive stress does not build up with in the sealed thick film dielectric electroluminescent display it is subject to variable ambient temperatures or to thermal shock that may lead to fracture of the display substrate or cover plate, the coefficient of thermal expansion (CTE) of the display substrate and the cover plate should be matched. The degree of CTE mismatch between these two components that can be tolerated can be empirically determined by subjecting sealed displays having different substrate and cover plate materials to thermal shock tests in accordance with display product reliability standards and testing methodology.

The above disclosure generally describes the present invention. A more complete understanding can be obtained by reference to the following specific Examples. These Examples are described solely for purposes of illustration and are not intended to limit the scope of the invention. Changes in form and substitution of equivalents are contemplated as circumstances may suggest or render expedient. Although specific terms have been employed herein, such terms are intended in a descriptive sense and not for purposes of limitation.

Example 1

Two 5 centimeter by 5 centimeter sheets of PD200 glass obtained from AG Electronic Materials, Hillsboro, Oreg. were bonded together with a 0.46 millimeter thick sheet of EV15295P/VF adhesive obtained from SIR of Enfield, Conn., USA. The resulting laminate was exposed to temperature cycling between −40° C. and 80° C. with a rate of temperature increase in the range of 5° C./minute to 6° C./minute and temperature stabilization times of between 0.3 hours and 14 hours at a relative humidity in the range of 10 to 15 percent. No evidence of delamination of the structure was observed, suggesting that the adhesion between the glass and the bonding layer was adequate.

Example 2

Laminated test structures of dimensions 6 millimeters by 10 millimeters consisting of a 25 nanometer thick alumina film, a 0.4 micrometer thick europium doped barium thioaluminate film and a 100 nanometer thick aluminum nitride film sequentially deposited on a 5 centimeter by 5 centimeter Asahi PD200 glass substrate of thickness 1.5 millimeters were fabricated. The test structures reflect the thin film phosphor structure of a thick film dielectric electroluminescent display. A second 5 centimeter by 5 centimeter sheet of PD200 glass was bonded to the side of the first substrate onto which the test structures were fabricated using a similarly sized EV 15295P/VF adhesive sheet. The sealed test structures were exposed in an environmental chamber to a temperature of 65° C. and a relative humidity of more than 90 percent and were inspected for degradation at time intervals. Damage was first noted at a test structure edge that was one centimeter from the edge of the substrate after 28 hours of exposure in the environmental chamber. After 42 to 52 hours all of the test structures had been destroyed. The results of the test show that degradation of a moisture sensitive laminated structure can be delayed by the presence of an encapsulating seal structure with an adequate overlap beyond the edge of the test structure.

Example 3

A 43 centimeter (17 inch) diagonal thick film dielectric electroluminescent display with a europium activated barium thioaluminate phosphor film and with photoluminescent colour conversion and optical filter layers printed onto the upper surface of the electroluminescent display structure was constructed on a PD200 glass substrate. A 1.1 millimeter thick Schott D263T cover glass was bonded over the display using a 0.46 millimeter thick sheet of 15295P/UF EVA adhesive from STR of Enfield, Conn. The adhesive sheet was cut to a slightly smaller size then the cover glass to allow for extrusion of the adhesive beyond the perimeter of the cover glass during the lamination process. The adhesive and cover glass extended beyond the perimeter of the thick film dielectric layer to form an annular region outside of the thick dielectric layer of the display structure where the adhesive layer was directly in contact with a sequentially deposited stack consisting of a barium titanate layer deposited by spin coating and firing a metal organic solution as disclosed in U.S. Pat. No. 6,589,674, a sputtered barium tantalate layer and an alumina layer covering the entire surface of the display substrate following deposition of the thick film dielectric layer or with gold connector strips positioned around the perimeter of the display substrate leading to the display electrodes. The width of the annular region was 5 to 6 millimeters on the column electrode sides of the display and 3 to 4 millimeters on the row electrode sides of the display. The seal lamination process was performed by placing the display substrate on a platen in a vacuum laminating chamber heated to 155° C., evacuating the lamination chamber for 300 seconds to a pressure of 1.3 mbar and then pressing at a pressure of 0.5 atmospheres for 7 minutes before cooling. A partial plan view of the extent of some of the various layers making up the electroluminescent display structure is shown in FIG. 5.

The sealed display was stored in an environmental chamber at a temperature of 65° C. and a relative humidity of more than 90% and monitored for degradation at various time intervals. After 55 hours, some darkening near the edge of the display structure was noted. After 151 hour the darkening had spread inwards from the edge of the thick dielectric layer of the display structure by about 19 millimeters on the column electrode sides and on the row electrode sides. After 631 hours the darkening had spread further inwards by a total of about 32 millimeters on the column sides and 32 to 36 millimeters on the row sides.

A preliminary seal integrity test protocol suggests that the display should be able to withstand at least 250 hours at 65° C. and more than 90% relative humidity to meet product reliability and storage lifetime criteria. Therefore these test results indicate that the width of the annular region around the thick film layer of the displays should be wider than the 3 to 4 millimeters provided on the row electrode sides of the display and 3 to 6 millimeters on the column sides of this display.

Example 4

A display similar to that of Example 3 was constructed except that the flexible connectors for the row and column electrodes were attached prior to bonding the cover glass to the display substrate, and the width of the annular region of the seal between the perimeter of the thick dielectric layer and innermost ends of the flexible connectors on the row electrode sides was 4.5 millimeters or 9 millimeters, depending on the positioning of each flexible connector strip. The width of the annular region of the seal between the perimeter of the thick film dielectric layer and innermost ends of the flexible connectors on column electrode sides was 7 millimeters. A further difference between the displays of example 3 and example 4 is that the latter had a cover glass of 1.5 millimeter thick Asahi PD200 glass rather than Schott D263T glass.

This display was subject to the same 65° C. and more than 90% relative humidity environment as the display of example 3. In this case, the propagation of darkened regions of the display structure had penetrated only 8 millimeters inward from the perimeter of the thick dielectric layer on the column sides and by 12 millimeters inwards from the perimeter of the thick dielectric layer on the row sides of the display after 320 hours of storage. After 648 hours of storage, the propagation of damaged regions of the display structure had penetrated only 18 millimeters inward from the perimeter of the thick film dielectric layer on the column sides and by 20 millimeters inwards from the perimeter of the thick dielectric layer on the row sides of the display. Thus the wider annular region provided in this display provided significantly greater protection against permeation of deleterious species such as moisture from the outside environment than for the display of example 3 with the narrower annular region. Further the effectively wider annular region on the column sides provided greater protection than the narrower annular region on the row sides. Extrapolation of the data from examples 3 and 4 suggest that the annular region should be at least about 9 millimeters wide to provide an adequate seal against ambient moisture.

Example 5

A sample was constructed similar to that of example 2 except that soda lime float glass obtained from Glayerbel of Belgium was used in place of Asahi PD200 glass. In this test, exposure to damp heat caused the glass to separate from the adhesive and the cover glass to crack. This test indicated that thermal expansion matching between the display substrate and the cover glass and proper surface treatment for the glass are important considerations.

Although preferred embodiments of the invention have been described herein in detail, it will be understood by those skilled in the art that variations may be made thereto without departing from the spirit of the invention.

The invention claimed is:

1. An adhesive layer, the adhesive layer being of an organic or polymer material and wherein said adhesive layer is bonded within a thick film dielectric electroluminescent display, said display comprising a composite thick film dielectric layer as part of a display sub-structure, to seal said thick film dielectric electroluminescent display, wherein said adhesive layer extends at least 3 millimeters beyond a perimeter of the display sub-structure and has one or more of the following functions: to reduce the ingress of moisture and atmospheric contaminants that react with layers of the thick film dielectric electroluminescent display; helps to contain the gaseous and vapour species generated within the thick film dielectric electroluminescent display during operation; inhibit chemical reactions that cause thick film dielectric electroluminescent display degradation; contain pressures within the thick film dielectric electroluminescent display; strengthen the overall mechanical integrity of the thick film dielectric electroluminescent display; and withstand mechanical and thermal stresses.

2. The adhesive layer of claim 1, wherein said sealed thick film dielectric electroluminescent display comprises said adhesive layer on an underside of a cover plate of said display.

3. The adhesive layer of claim 2, wherein said organic material is an organic material.

4. The adhesive layer of claim 3, wherein said organic material is selected from the group consisting of ethylene vinyl acetate (EVA), thermoplastic polyurethanes (TPUs), polyvinyl butyral (PVB) and other thermoplastic or thermally curable adhesive organic materials.

5. The adhesive layer of claim 1, wherein when cured the adhesive layer has an optical index of refraction of less than or about equal to that of an optically transparent coverplate within the display.

6. The adhesive layer of claim 5, wherein said adhesive layer has a thickness of about 0.05 to about 0.5 mm.

7. A sealed thick film dielectric electroluminescent display, said display comprising:

a display sub-structure comprising a thick film dielectric layer;

an adhesive layer provided over said display sub-structure that extends at least 3 millimeters beyond a perimeter of the display sub-structure; and a cover plate provided over said adhesive layer, wherein said adhesive layer bonds the cover plate to the display sub-structure, wherein said adhesive layer has one or more of the following functions: helps to contain the gaseous and vapour species generated within the thick film dielectric electroluminescent display during operation; inhibits chemical reactions that cause thick film dielectric electroluminescent display degradation; and contains pressures within the thick film dielectric electroluminescent display.

8. The sealed display of claim 7, wherein the display sub-structure comprises in order; a substrate, lower electrode, thick film dielectric layer having a smoothing layer thereon, a phosphor layer, thin film dielectric layer, sub-pixel columns, comprising an indium tin oxide layer and color conversion layer and the adhesive layer and cover plate at least 9 millimeters beyond the perimeter of the display sub-structure.

9. The sealed display of claim 8, wherein the colour conversion layer of the display sub-structure is provided directly adjacent the underside of the cover plate and the adhesive layer is provided directly adjacent the underside of the colour conversion layer.

10. The sealed display of claim 7, wherein said adhesive layer is an organic or polymer material.

11. The sealed display of claim 10, wherein said organic material is selected from the group consisting of ethylene vinyl acetate (EVA), thermoplastic polyurethanes (TPUs), polyvinyl butyral (PVB) and other thermoplastic or thermally curable adhesive organic materials.

12. The sealed display of claim 7, wherein when cured the adhesive layer has an optical index of refraction of less than or about equal to that of an optically transparent coverplate within the display.

13. The sealed display of claim 7, wherein said adhesive layer has a thickness of about 0.05 to about 0.5 mm.

14. The sealed display of claim 7, wherein the adhesive layer is provided to an underside of the cover plate and the cover plate is aligned with and bonded to the remainder of the display sub-structure.

15. The sealed display of claim 14, wherein the cover plate has been aligned and bonded in a vacuum where enclosed air is removed.

16. The sealed display of claim 15, wherein the display is heated.

17. The sealed display of claim 16, wherein the heated display has further been exposed to pressure during formation of the sealed display.

18. The sealed display of claim 17, wherein the pressure is about 0.5 to 1 milliTorr.

19. The sealed display of claim 16 wherein said display is heated to a temperature of about 120° C. to about 200° C.

20. The sealed display of claim 7 wherein the adhesive layer further has one or more of the following functions: to reduce the ingress of moisture and atmospheric contaminants that react with layers of the thick film dielectric electroluminescent display; strengthen the overall mechanical integrity of the thick film dielectric electroluminescent display; and withstand mechanical and thermal stresses.

* * * * *